United States Patent [19]

Plemmons et al.

[11] 4,387,417

[45] Jun. 7, 1983

[54] LAMP RETAINING MEANS WITHIN LUMINAIRE

[75] Inventors: Jerry R. Plemmons, West Asheville; Tommy R. Taylor, Fletcher, both of N.C.

[73] Assignee: General Electric Company, Schenectady, N.Y.

[21] Appl. No.: 336,113

[22] Filed: Dec. 30, 1981

[51] Int. Cl.[3] ..... F21V 15/00

[52] U.S. Cl. ..... 362/376; 362/306; 362/369; 362/390

[58] Field of Search ..... 362/306, 376, 390, 369

[56] References Cited

U.S. PATENT DOCUMENTS 2,003,507 6/1935 Guljas ..... 362/390

*Primary Examiner*—Stephen J. Lechert, Jr.

*Attorney, Agent, or Firm*—Ernest W. Legree; Philip L. Schlamp; Fred Jacob

[57] ABSTRACT

A retaining means for a lamp within a luminaire provides structural support and positive positioning. It comprises a resilient wire formed to a four-sided parallelogram shape with four outboard reverting projections between segments. One pair of diametrically opposed projections encircle bolts which hold the retainer transversely to the lamp axis at the rim of the socket compartment. Another pair of projections are unrestrained and provide extra flexibility in accommodating to variations in lamp diameters.

4 Claims, 3 Drawing Figures

LAMP RETAINING MEANS WITHIN LUMINAIRE

The present invention relates to luminaires and particularly to locating and retaining means for the lamp within a luminaire.

BACKGROUND OF THE INVENTION

High intensity lamps such as mercury, metal halide or high pressure sodium lamps commonly used in lighting fixtures are usually single-ended and have a screw base. While the socket into which the lamp is screwed will locate it and hold it in place, it is desirable to have some additional means to positively locate the lamp in the desired attitude or location relative to the luminaire's design light center. Also in installations subject to vibration it is desirable to have some additional means to counter the effects thereof and prevent the lamp for loosening and possibly fracturing at the socket and falling out. This is particularly desirable in outdoor luminaires, especially street or highway lighting fixtures which are subject to roadway vibration and pole sway caused by wind.

In U.S. Pat. No. 3,694,649—Thompson, Lamp Support Device, a retaining device for countering the effects of vibration is described. It takes the form of a pair of elongated stiff wire members secured to an adjustable lamp socket bracket. These members extend axially to the neck portion of the lamp and have curved end portions which engage the neck while encircling it. In addition to protecting the lamp against vibration-loosening under service conditions, the support device also facilitates relamping. By providing support adequate to retain the lamp in the fixture even after the base is fully disengaged from the socket, the possibility of the lamp being accidentally dropped by the electrician and resultant breakage is greatly reduced.

SUMMARY OF THE INVENTION

The object of our invention is to provide an improved retaining means for a lamp within a luminaire which adapts to variations in lamp stem diameters, and provides structural support and positive positioning of the lamp in relation to the reflector together with ease of lamp replacement. A retaining means is desired which is cheaper to make than what has been used heretofore and which is easily installed while the luminaire is being assembled.

In accordance with our invention we provide a resilient wire retaining means formed to a four-sided parallelogram shape with four outboard reverting projections between sides or segments. Conveniently one pair of diametrically opposed projections may be curved to encircle fixing means such as bolts which hold the retainer relative to the luminaire's optical assembly. The other pair are not restrained and provide extra material for flexing in accommodating to variations in lamp diameter.

In a preferred embodiment, the retaining means is made of a single length of spring wire extending from one terminal loop to a diametrically opposite reverting loop, and then back to a second terminal loop which is juxtaposed to the first on a common axis. The two juxtaposed terminal loops encircle one retaining bolt and the reverting loop encircles the other retaining bolt to hold the retainer in place relative to the optical assembly.

DETAILED DESCRIPTION

Figure 1:
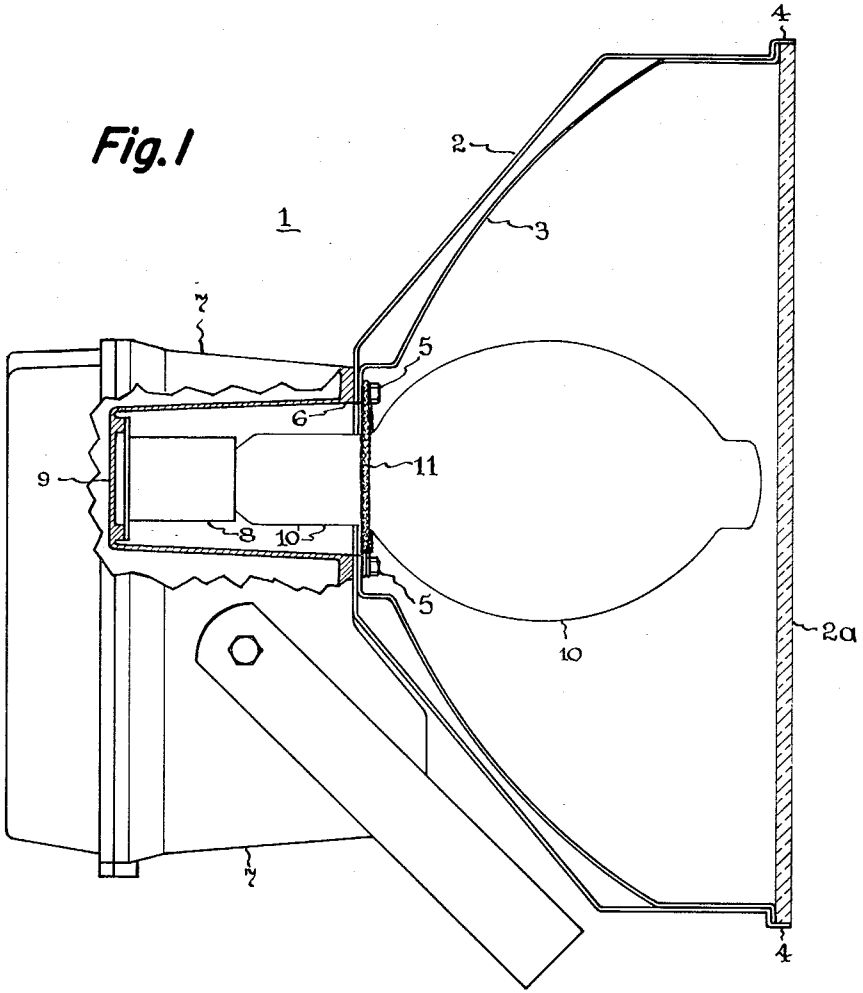
FIG. 1 is a side elevational view, partly sectioned and with parts broken away of a luminaire in which the invention is embodied.

Referring now to the drawing and particularly to FIG. 1, there is shown a luminaire 1 in which the lamp retaining means of the invention finds particular utility. The luminaire comprises an optical assembly which includes a dome-shaped housing 2 enclosing an inner polished reflector 3. The reflector has a configuration producing a desired distribution of reflected light when a lamp is properly located relative to the design light center. The reflector is engaged by the domed housing at the rim 4. The entire optical assembly depends from and is fastened by bolts 5 or the like to the rim of a generally cylindrical socket compartment 6 which forms part of a ballast housing 7. The ballast housing including the socket compartment may be an aluminum casting. The open end of domed housing 2 may be closed by a light-transmitting closure or window **2*a*** in known fashion, for instance as described in U.S. Pat. No. 3,694,649—Thompson, whose disclosure is incorporated herein by reference.

A conventional single-ended lamp socket 8 is accommodated within compartment 6, being fastened to its inner end wall 9. Within the ballast housing 7 are mounted electrical operating components such as a ballast transformer (not shown) for operating a discharge lamp 10 shown screwed into socket 8. The illustrated lamp, a 1000 watt metal halide lamp such as those sold under the registered trademark Multi-Vapor, is but one example of a high intensity lamp which may be used in the luminaire.

Figure 2:
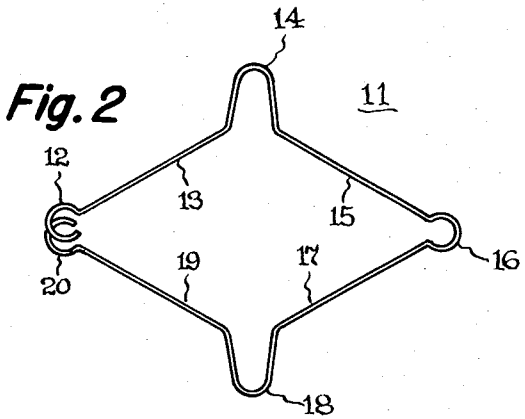
FIG. 2 is a plan view of the spring wire retainer.
Figure 3:
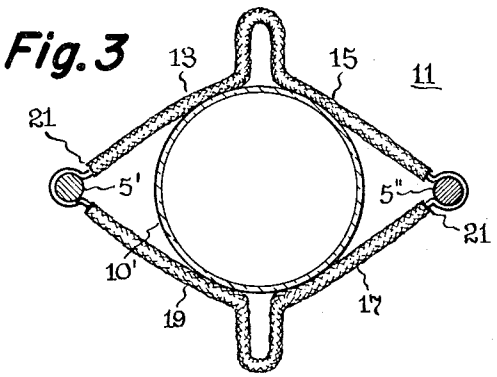
FIG. 3 is a cross-sectional view through the lamp neck in FIG. 1 showing the retainer in place.

In accordance with the present invention a lamp retaining means is constructed and arranged in the luminaire to clamp resiliently about the neck 10' of the lamp. The retaining means must permit easy lamp replacement yet provide sufficient restraint to positively locate the lamp on axis at the design light center and also retain the lamp when it is unscrewed from the socket. Also it must accommodate variations in lamp diameter due to manufacturing tolerances, securely holding smaller diameter lamps but without fracturing together diameter ones. Referring to FIGS. 2 and 3, this is accomplished by a flexible wire retainer 11 made of spring wire formed to a four-sided parallelogram shape with outboard reverting projections between sides or segments. The retainer is held in place, transverse to the lamp axis across the mouth or rim of socket compartment 6 by two of the four bolts which fasten the optical assembly to the ballast housing at the rim of the socket compartment. These bolts 5' and 5'' engage one opposed pair or set of reverting projections.

In the preferred construction best seen in FIG. 2 the retainer 11 is made of a single length of resilient wire, suitably 1/16" diameter steel spring wire. The wire is bent or formed as follows: beginning with a terminal loop 12, there follows a straight segment 13, then a cusp-like outboard projection 14, a straight segment 15, a reverting loop 16, a straight segment 17, a cusp-like outboard projection 18, a straight segment 19 and finally a terminal loop 20. The retainer is preferably sheathed by a cushioning material capable of withstanding the lamp's operating temperature, suitably glass cloth sleeving 21 as shown in FIG. 3, to prevent metal-to-glass contact.

When the retainer is installed in the luminaire, the two terminal loops 12 and 20 are juxtaposed, that is superposed on behind the other under one of the retaining bolts 5', while the reverting loop 16 is engaged by the other retaining bolt 5''. The retaining bolts 5',5'' are shouldered so as to clamp the optical assembly tightly against the rim of socket compartment 6 but leaving the loops of the retainer 11 free to flex. Our retainer design thus provides for quick and easy installation in the process of assembling the luminaire components.

In use, a lamp 10 is inserted into the socket compartment, the straight segments 13,15 and 17,19 are forced out and bent slightly, thus exerting pressure against the neck 10' of the lamp. The cusp-like projections or outboard ribs 14 and 18 tend to close in flexing while the reverting loop 16 tends to open. The terminal loops 12 and 20 have an action similar to that of the reverting loop 16. The arrangement according to the invention thus assures adequate flexibility to accommodate expected variations in lamp neck diameter without fracturing the lamp, while exerting sufficient pressure on the lamp neck to hold the lamp securely in place.

The particular embodiment which has been illustrated and described in detail will accommodate 1000 and 1500 watt metal halide lamps, 1000 and 1500 watt mercury lamps, and 1000 watt high pressure sodium lamps. Such lamps have a nominal neck diameter of 2.250" with a permissible manufacturing tolerance of +0.250" and −0.062". Of course such embodiment is intended only as an illustrative example and the appended claims are intended to cover modifications that those skilled in the art may make without departing from the spirit and scope of the invention.

What we claim as new and desire to secure by Letters Patent of the United States is:

1. A luminaire comprising an optical assembly having a design light center, a single-ended lamp socket, means for supporting said socket relative to said assembly so as to locate a lamp accommodated by it in a predetermined attitude relative to the light center, and a lamp retainer within said luminaire for positively locating the lamp in said attitude and securely holding it by engaging its neck, comprising: resilient wire formed to a four-sided parallelogram shape with outboard reverting projections between sides, fixing means engaging one diametrically opposed pair of said projections for fixing said retainer relative to the optical assembly, the other pair of said projections being unrestrained and providing extra flexibility in accommodating different-sized lamps.

2. A luminaire as in clam 1 wherein the means for supporting said socket includes a ballast housing having a socket compartment in which the socket is mounted, the optical assembly being fastened to the ballast housing at the rim of said socket compartment, and the fixing means for the lamp retainer being also fastened transversely to the optical axis at the rim of said socket compartment.

3. A luminaire as in claim 1 wherein said lamp retainer is made of a single length of spring wire extending from one terminal loop to a diametrically opposite reverting loop and then back to a second terminal loop, said two terminal loops superposed on one side and said reverting loop on the other side forming the diametrically opposed pair of projections engaged by said fixing means.

4. A luminaire as in claim 3 wherein the outboard projections formed in said spring wire intermediate each of said terminal loops and the reverting loop are cusp-like.

* * * * *